US007861531B2

(12) United States Patent
Bunel et al.

(10) Patent No.: US 7,861,531 B2
(45) Date of Patent: Jan. 4, 2011

(54) FAIRING FOR A COMBUSTION CHAMBER END WALL

(75) Inventors: Jacques Marcel Arthur Bunel, Fresnes (FR); Mario Cesar De Sousa, Cesson (FR); Stephane Henri Guy Touchaud, Vincennes (FR)

(73) Assignee: SNECMA, Paris (FR)

( * ) Notice: Subject to any disclaimer, the term of this patent is extended or adjusted under 35 U.S.C. 154(b) by 160 days.

(21) Appl. No.: 12/053,091

(22) Filed: Mar. 21, 2008

(65) Prior Publication Data

US 2008/0236164 A1 Oct. 2, 2008

(30) Foreign Application Priority Data

Mar. 27, 2007 (FR) ..... 07 54051

(51) Int. Cl.
*F02C 1/00* (2006.01)

(52) U.S. Cl. ..... 60/752; 60/796

(58) Field of Classification Search ..... 60/39.37, 60/752, 756, 796, 799, 800
See application file for complete search history.

(56) References Cited

U.S. PATENT DOCUMENTS 3,854,285 A * 12/1974 Stenger et al. ..... 60/756
4,843,825 A * 7/1989 Clark ..... 60/756
5,197,289 A * 3/1993 Glevicky et al. ..... 60/746
5,524,430 A * 6/1996 Mazeaud et al. ..... 60/798
5,623,827 A * 4/1997 Monty ..... 60/748
6,148,600 A 11/2000 Farmer et al.
6,557,349 B1 * 5/2003 Young et al. ..... 60/752
6,708,498 B2 * 3/2004 Stickles et al. ..... 60/776
7,222,488 B2 * 5/2007 Farmer et al. ..... 60/747
2007/0180809 A1 * 8/2007 Bessagnet et al. ..... 60/39.01
2007/0186558 A1 * 8/2007 De Sousa et al. ..... 60/804
2008/0010997 A1 * 1/2008 Bessagnet et al. ..... 60/805

FOREIGN PATENT DOCUMENTS

EP 0 488 557 A1 6/1992
EP 1 265 031 A1 12/2002

* cited by examiner

*Primary Examiner*—William H Rodriguez
*Assistant Examiner*—Phutthiwat Wongwian
(74) *Attorney, Agent, or Firm*—Oblon, Spivak, McClelland, Maier & Neustadt, L.L.P.

(57) ABSTRACT

An annular fairing for covering the annular chamber end wall of a turbomachine combustion chamber, and in particular of an airplane turbojet. The fairing presents openings for passing fuel injectors that are supported by the chamber end wall. The fairing is subdivided into a plurality of adjacent sectors, each sector presenting inner and outer fastener edges capable of being fastened on either side of said chamber end wall. Each sector includes a lip on one of its side edges, which lip is connected to the remainder of the sector by a step, said lip being designed to over the side edge of the adjacent sector.

7 Claims, 4 Drawing Sheets

FAIRING FOR A COMBUSTION CHAMBER END WALL

The present invention relates to an annular fairing for covering the annular end wall of a turbomachine combustion chamber. The invention is applicable to any type of terrestrial or aviation turbomachine, and more particularly to airplane turbojets.

BACKGROUND OF THE INVENTION

Conventional turbojet combustion chambers comprise an inner wall, an outer wall, and in the upstream region of the chamber, an annular end wall disposed between said inner and outer walls. The chamber end wall supports injector heads that spray fuel into the combustion chamber.

Those conventional combustion chambers also have an annular fairing serving firstly to cover the upstream (i.e. front) end of said chamber end wall together with said injector heads so as to protect them from any impact (as can occur if a bird or a block of ice is ingested into the turbojet), and secondly to ensure that the chamber end wall is aerodynamically contoured allowing air to flow with little head loss.

In the present application, "upstream" and "downstream" are defined relative to the normal flow direction of gas (from upstream to downstream) through the turbomachine, and the adjectives "inner" and "outer" are used relative to a radial direction, i.e. a direction perpendicular to the axis of rotation X of the turbomachine rotor. Thus, the inner portion of an element is closer to the axis X than is the outer portion of the same element.

Certain known fairings are made up of two separate and concentric annular parts commonly referred to as "cowls", that extend around the inner periphery and the outer periphery of the chamber end wall. These inner and outer "cowls" are fastened to the combustion chamber and they are separated by an annular gap that gives access to the injector heads and through which the fuel injectors pass that are connected to the injector heads. A "cowl" type fairing is described for example in document EP 1 265 031 A1.

Other so-called "one-piece" fairings are also known that are made from a single annular part. The two fairing "cowls" are then interconnected by bars that define between them openings through which the fuel injectors pass. In half-section in an axial plane containing the axis of rotation X, the fairing presents a shape that is substantially semicircular. Since it is more rigid, that type of fairing is better at withstanding stresses of vibratory origin than are the previously-described fairings with cowls. A one-piece fairing is described for example in document U.S. Pat. No. 6,148,600.

Fairings are generally bolted since assembly by bolting provides much greater latitude in terms of maintenance than does assembly by welding.

To mount a fairing on a chamber end wall, the inner and outer edges of the fairing are fastened by means of bolts that are regularly distributed around the chamber end wall. During this step, the bolt needs to be tightened quite considerably in order to take up assembly clearances that are inherent to fabrication and mounting tolerances, and that has the drawback of causing the fairing to lose its annular shape, the inner and/or outer edges of the fairing forming deformation lobes between pairs of bolts, giving these edges a "daisy" shape. These lobes cause gaps to appear between the assembled parts, giving rise to air leakage and head losses. In addition, given said mounting clearances, the mechanical stiffness of the assembly leads either to tightening with torque that is greater than can be accommodated by the bolt and/or the fairing, or else to insufficient contact for friction to pass operating forces via the bolted connections.

To reduce those drawbacks significantly, a known solution consists in making slots in the edges of the fairing, between the bolts, in order to provide a little more flexibility while the fairing is being put into place, and thus improve the actual clamping of the parts. Nevertheless, that solution presents other drawbacks: in operation the slots lead to leaks of air that are harmful from an aerodynamic point of view and they also run the risk of constituting crack initiation points.

OBJECTS AND SUMMARY OF THE INVENTION

An object of the invention is to propose a fairing that avoids the above drawbacks.

This object is achieved by an annular fairing for covering the annular chamber end wall of a turbomachine combustion chamber, and presenting openings for passing fuel injectors that are supported by the chamber end wall, the fairing being subdivided into a plurality of adjacent sectors, each fairing sector presenting inner and outer fastener edges capable of being fastened on either side of said chamber end wall.

The fairing of the invention is fastened sector by sector onto the upstream edges of the outer and inner walls of the combustion chamber, thus making it possible to avoid forming the above-mentioned deformation lobes and to guarantee good contact between the fastener edges of each sector and said walls. In addition, there is no need to provide slots in the fastener edges, thereby avoiding the drawbacks associated with the presence of such slots.

In addition, with known fairings (as explained above), part of the bolt clamping force is used for deforming the fairing which is rigid. Since the fairing sectors of the invention are more flexible, it is possible either to reduce the clamping force, or else to obtain better contact between the assembled-together parts for the same clamping force.

In a particular embodiment of the invention, said sectors present side edges such that the side edges of two adjacent sectors overlap.

By means of such overlap, air leakage between two adjacent sectors is avoided.

Furthermore, better vibration damping is obtained with the fairing in sectors of the invention than with the previously-known one-piece or "cowl" fairings, since each fairing sector has its own dynamic behavior and friction between adjacent sectors contributes to said damping. Diametral resonance modes are also avoided of the kind that are specific to annular parts and liable to give rise to resonance with harmonics of the engine speed.

The inner and outer fastener edges of each sector are fastened respectively to the inner and outer walls of the combustion chamber. In a particular embodiment of the invention, each of said fastener edges is fastened at N fastening points, where N is greater than or equal to 2, and at least N-1 of said fastening points are made by means of a respective fastener element (in particular a bolt) passed through a hole that is oblong.

Said N-1 oblong holes extend in the circumferential direction of the fairing, and the holes enable said fastener elements to move circumferentially during mounting, such movement being due to the radial approach of the fairing to the diameters of the outer, inner, and end walls of the combustion chamber. This enables better contact and thus more effective clamping in the assembly, and avoids generating stresses in the sectors.

In another particular embodiment of the invention, the inner and outer fastener edges of each sector are each fastened at a single fastening point, said fastening point being situated outside the sector overlap zone.

Having a single fastening point per fastener edge avoids problems associated with expansion differences between the assembled-together parts, in the event of such expansion differences being large while the turbomachine is in operation. In addition, since said fastening points are generally provided by means of a fastener element, in particular a bolt, passing through a hole formed in the sector, reducing the number of fastening points as much as possible reduces the number of fastener elements (bolts) that are used, thereby achieving a saving in weight. There is also a reduction in the number of holes to be made and thus in the cost of fabricating each sector. In addition, since the side edges of two adjacent sectors overlap, a sector contributes to holding in place the adjacent sector that it overlaps. Finally, as described below, the operation of fastening the sectors on the outer, inner, and end walls of the chamber remains simple.

BRIEF DESCRIPTION OF THE DRAWINGS

The invention and its advantages can be well understood on reading the following detailed description of the invention. The description refers to the accompanying sheets of figures, in which.

MORE DETAILED DESCRIPTION

Figure 1:
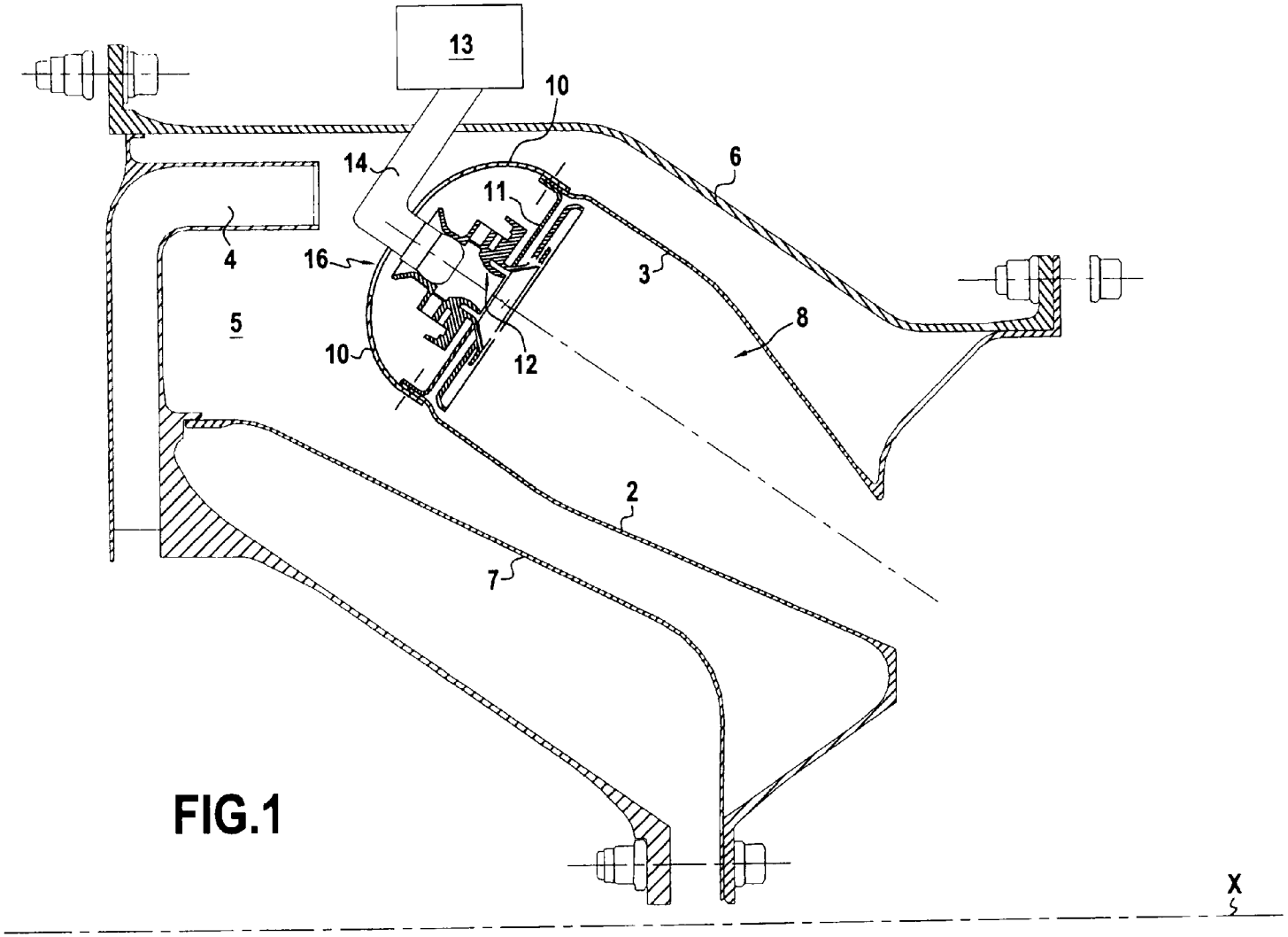
FIG. 1 is a diagrammatic view showing an example of a combustion chamber of the invention in its environment inside an airplane turbojet, the figure being in axial half-section in an axial plane containing the axis of rotation X of the turbojet. The end wall of the combustion chamber is covered by a fairing.

FIG. 1 shows an example of a turbojet in half-section on a section plane containing the axis of rotation X of the turbojet rotor. The turbojet comprises a centrifugal high-pressure compressor (not shown), and downstream therefrom a diffuser 4 opening out into a space 5 defined between concentric outer and inner casings 6 and 7, and occupied by an annular combustion chamber 8 supported by the casings 6 and 7.

Although FIG. 1 relates to a turbojet with a centrifugal compressor, the invention is not limited to this type of turbomachine.

The combustion chamber 8 has an inner 2 wall, an outer wall 3, and, in the upstream region of said chamber, an annular end wall 11 disposed between said inner and outer walls. This end wall 11 presents inner and outer fastener rims 11*a* and 11*b* folded upstream relative to the main portion of the end wall 11.

The end wall 11 carries injector heads 12 forming part of a system 13 for feeding fuel via fuel injectors 14 passing through the space 5. These elements shown in FIG. 1 are not reproduced on the other figures.

The combustion chamber 8 is fitted with an annular fairing 10. The fairing 10 covers the end wall 11 to protect it, and presents openings 16 for passing said injectors 14. The section of the fairing 10 in the plane of FIG. 1 is substantially semicircular in shape. Thus, the fairing 10 presents good stiffness and therefore better dynamic behavior than the behavior of prior art "cowl" fairings. It is also suitably aerodynamically contoured.

Figure 5:
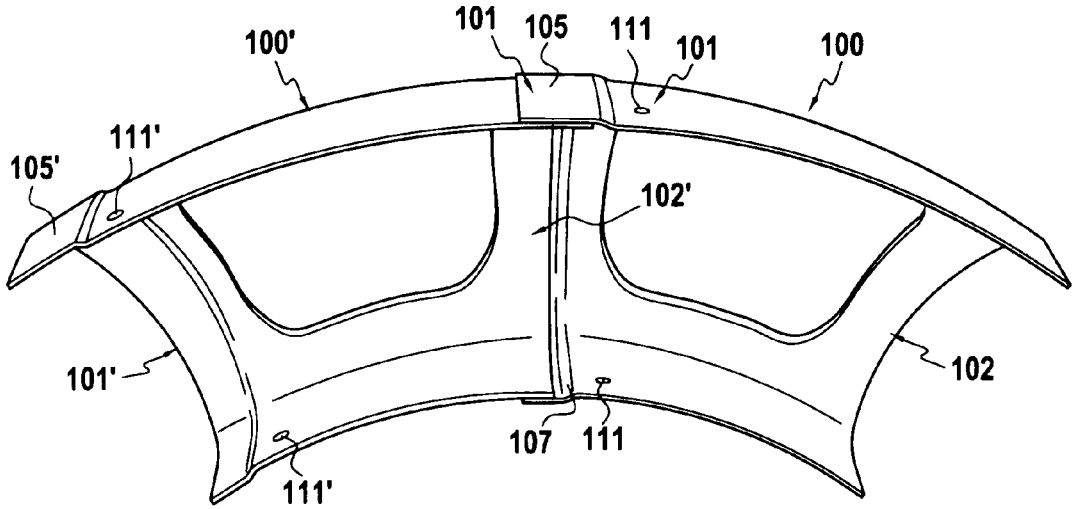
FIG. 5 is a view analogous to FIG. 4, showing two adjacent sectors of another example of a fairing of the invention.
Figure 6:
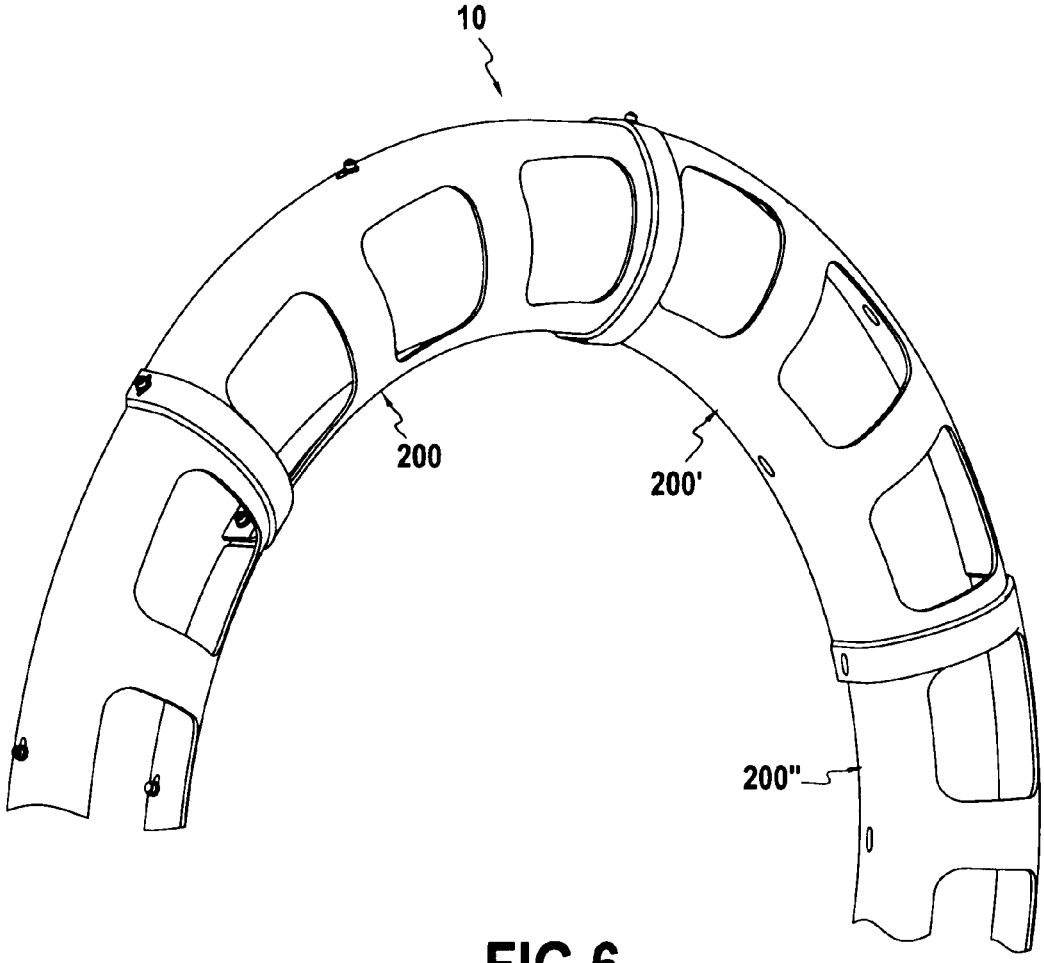
FIG. 6 is a perspective view showing a plurality of adjacent sectors of another element of a fairing of the invention.

In addition, in accordance with the invention, the fairing 10 is subdivided into a plurality of adjacent sectors referenced 100, 100' (see FIGS. 2 to 5) or 200, 200', 200" (see FIG. 6). In this example, the adjacent sectors are all identical, which enables them to be mass produced.

Naturally, the number of sectors can vary. Thus, for a combustion chamber 8 having eighteen fuel injectors 14, fitted with a fairing 10 presenting one opening 16 for each injector 14, i.e. eighteen openings, it is possible for example to subdivide the fairing into eighteen sectors, each sector presenting a single opening 16, or indeed to subdivide a fairing into nine, six, or even three sectors, each sector then presenting respectively two, three, or six openings 16. Naturally, the smaller the number of sectors, the quicker the fairings 10 can be assembled, but the smaller the flexibility of the sectors. Conversely, the greater the number of sectors, the more flexible they are and the easier it is to obtain good contact between the fastening edges of these sectors and the outer and inner walls 3 and 2, but the longer it takes to assemble the fairing 10. Furthermore, the greater the number of sectors, the better vibration is damped.

In general, each fairing sector presents at least one opening allowing at least one fuel injector to pass therethrough. FIGS. 2 to 5 show embodiments in which each sector 100, 100' presents a single opening 16 allowing one fuel injector 14 to pass therethrough. FIG. 6 shows an embodiment in which each sector 200, 200', 200" presents three openings 16, each opening serving to pass one fuel injector 14. In other embodiments (not shown), each fairing sector presents one or more openings, each opening extending far enough circumferentially to allow a plurality of fuel injectors to pass therethrough.

With reference to FIGS. 2 to 5, each sector 100 overlies the upstream side of the chamber end wall 11 and has inner and outer fastener edges 100*a* and 100*b* that are fastened to the inner and outer fastener rims 11*a* and 11*b* of the chamber end wall 11, and to the upstream edges 2*a* and 2*b* of the inner and outer walls 2 and 3 at various fastening points. More precisely, the outer fastener edge 100*b* (or the inner edge 100*a*) of the fairing sector, the upstream edge 3*b* (or 2*a*) of the outer wall 3 (or inner wall 2), and the outer fastener rim 11*b* (or inner rim 11*a*) of the chamber end wall 11 are superposed from the outside towards the inside of the combustion chamber 8, and they have holes passing therethrough that coincide with one another and that receive bolts 15. The bolts 15 hold said edges 100*a*, 100*b*, 3*a*, 3*b*, and rims 11*a*, 11*b* assembled to one another and they are distributed around two concentric circles around the axis X.

Each of the adjacent sectors 100 and 100' in FIGS. 2 to 5 present two side edges 101, 102 and 101', 102', and when these sectors are assembled together, the side edge 101 of the sector overlies the side edge 102' of the adjacent sector 100'. Thus, there are no circumferential gaps between the assembled-together sectors, thus making it possible to limit or even eliminate any leakage of air between the sectors.

More particularly, in the embodiment in the figures, each sector 100 has a lip 105 at its side edge 101 that is connected to the remainder of the sector by a step 107. This lip 105 overlaps the side edge 102' of the adjacent sector 100' when the sectors 100 and 100' are assembled together (see FIGS. 2, 4, and 5). The step 107 can also as an abutment for the side edge 102' of the sector 100', thus making it easier to put the sectors into place relative to one another.

Figure 2:
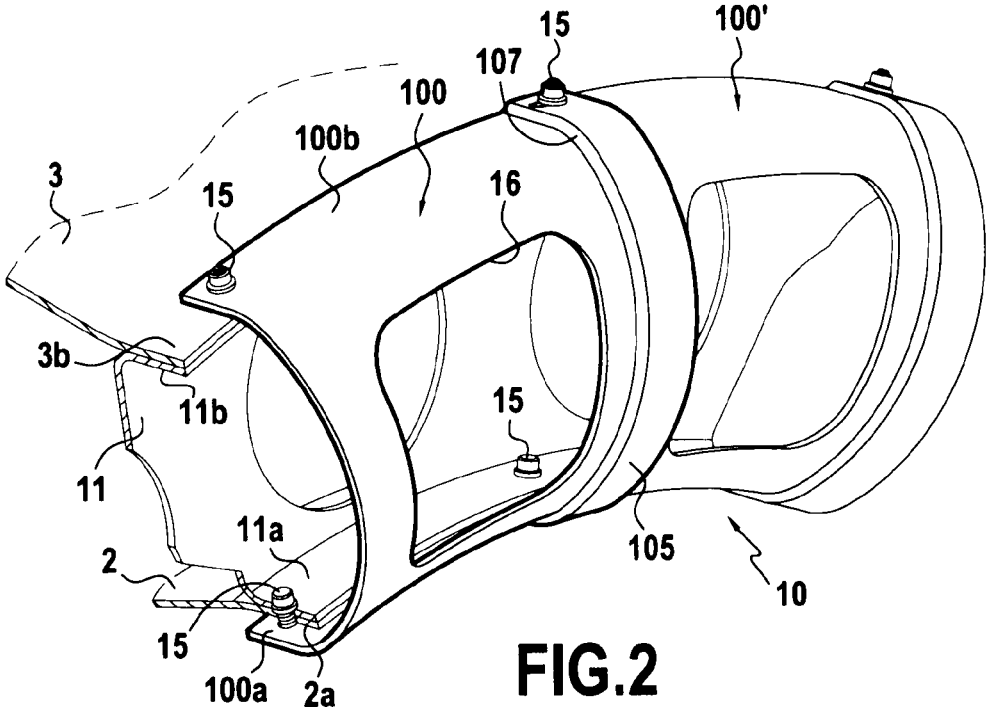
FIG. 2 is a perspective view of the upstream region of the FIG. 1 combustion chamber, covered by two adjacent sectors of an example of a fairing of the invention.
Figure 3:
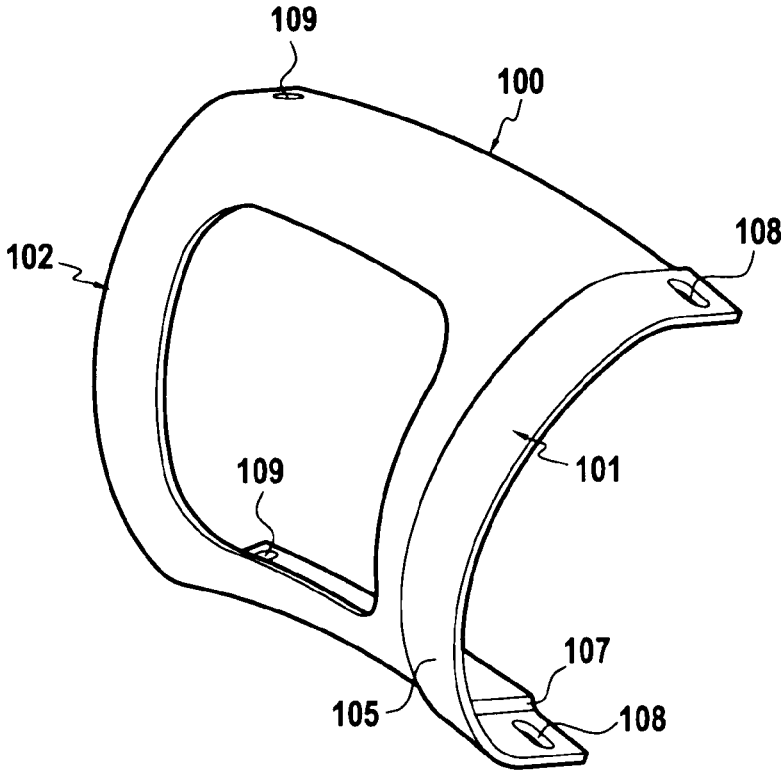
FIG. 3 is a perspective view of one of the FIG. 2 fairing sectors.
Figure 4:
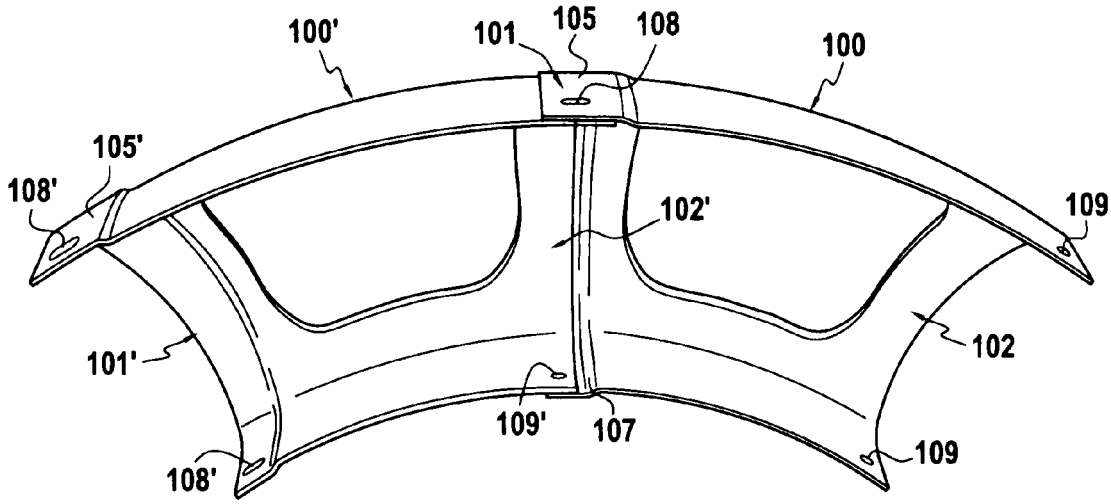
FIG. 4 is a perspective view of two FIG. 2 fairing sectors.

In the embodiments of FIGS. 2 to 4, the inner and outer fastener edges 100*a* and 100*b* of each sector 100 are each fastened at two fastening points. These two fastening points are situated respectively at the side edges 101 and 102 of the sector 100. More precisely, these two fastening points are implemented by means of a bolt 15 passed through a hole 108 or 109 passing through the corresponding fastener edge. At least one of said holes is oblong, its long dimension being oriented in the circumferential direction of the fairing 10. The oblong hole 100 allows the bolt 15 to move towards and away from each other, where such movement can be caused either during mounting of the sector 100 on the walls 2 and 3, or else in operation as a result of differences in expansion between the sector 100 and the walls 2, 3, and/or 11 of the chamber 8. This avoids stresses appearing in the sector 100.

In the embodiment of FIGS. 2 to 4, two circular holes 109 are formed respectively in the fastener edges 100*a* and 100*b* beside the side edge 102, while two oblong holes 108 are formed respectively in the fastener edges 100*a* and 100*b* beside the side wall 101. More precisely, the two oblong holes 108 pass through the lip 105.

FIG. 5 is a view analogous to that of FIG. 4 showing two adjacent sectors 100, 100' of another embodiment of a fairing of the invention. The fairing sectors 100, 100' in FIG. 5 differ from those in FIG. 4 solely concerning their fastening points with the chamber end wall. In the embodiment of FIG. 5, the inner and outer fastener edges 100*a* and 100*b* of each sector 100 are each fastened at a single fastening point. This fastening is provided by a bolt 15 passed through a hole 111 that passes through the fastener edge 100*a* or 100*b* of the sector. This minimizes the number of bolts 15 and of holes 111, thereby minimizing the weight and the cost of fabricating the sector 100.

Advantageously, said fastener point is situated outside the overlap zone between sectors 100, but is positioned close to said zone. In this way, part of the clamping force of the bolt 15 is used to cause the side edge 101 of the sector 100 to exert pressure on the side edge 102' of the adjacent sector 100' and to hold the sector 100' in position.

The fairing 10 of FIG. 5 can be assembled as follows: firstly the sector 100 is fastened to the chamber end wall 11, without fully tightening the bolts 15 passing through the openings 111, and then the side edge 102' of the adjacent sector 100' is passed under the lip 105. Thereafter, the second sector 100' is fastened without fully tightening the bolts 15 passing through the openings 111', so as to enable the side edge of another adjacent sector (not shown) to be passed under the lip 105' of the sector 100', and so on. Once all of the sectors are in place, the bolts 15 are fully tightened.

It should be observed that because the sectors overlap, the first sector 100, when fastened partially only (e.g. by the bolt 15 not being fully tightened), holds the second sector 100 before it is bolted to the chamber end wall. This makes it easier to mount the fairing sectors.

What is claimed is:

1. A combustion chamber comprising an inner wall, an outer wall, and in the upstream region of said chamber, an annular chamber end wall disposed between said inner and outer walls, said chamber end wall having an upstream face, this upstream face being covered by a fairing which presents openings adapted for passing fuel injectors that are supported by the chamber end wall, and which is subdivided into a plurality of adjacent sectors, each fairing sector presenting inner and outer fastener edges adapted for being fastened on either side of said chamber end wall, wherein said sectors present side edges, the side edges of two adjacent sectors overlapping in a circumferential direction thereby avoiding circumferential gaps between adjacent sectors.

2. A combustion chamber according to claim 1, wherein each sector includes, on one of its side edges, a lip connected to the remainder of the sector by a step, said lip being designed to overlap the side edge of an adjacent sector.

3. A combustion chamber according to claim 1, wherein the inner and outer fastener edges of each sector are each fastened at N fastening points, where N is greater than or equal to 2, and wherein at least N-1 of said fastening points are each constituted by means of a fastener element passed through an oblong hole.

4. A combustion chamber according to claim 1, wherein the inner and outer fastener edges of each sector are each fastened at a single fastening point, said fastening point being situated outside a zone where the sectors overlap.

5. A combustion chamber according to claim 1, wherein each fairing sector presents at least one opening enabling at least one fuel injector to pass therethrough.

6. A turbomachine including a combustion chamber according to claim 1.

7. A combustion chamber according to claim 1, wherein the chamber end wall has inner and outer fastener rims, the inner and outer fastener edges of the fairing being fastened to the inner and outer fastener rims.

* * * * *